US009127484B2

(12) United States Patent
Mani

(10) Patent No.: US 9,127,484 B2
(45) Date of Patent: Sep. 8, 2015

(54) LEVER DROOP ADJUSTER FOR A DOOR LATCH ACTUATOR

(75) Inventor: Vijayakumar Mani, Karnataka (IN)

(73) Assignee: Schlage Lock Company LLC, Indianapolis, IN (US)

( * ) Notice: Subject to any disclaimer, the term of this patent is extended or adjusted under 35 U.S.C. 154(b) by 220 days.

(21) Appl. No.: 13/534,783

(22) Filed: Jun. 27, 2012

(65) Prior Publication Data

US 2014/0001772 A1 Jan. 2, 2014

(51) Int. Cl.

| | |
|---|---|
| ***E05C 1/12*** | (2006.01) |
| ***E05B 63/00*** | (2006.01) |
| ***E05B 3/06*** | (2006.01) |

(52) U.S. Cl.

CPC ..... *E05B 63/0056* (2013.01); *E05B 3/065* (2013.01); *Y10T 29/49817* (2015.01); *Y10T 292/0994* (2015.04); *Y10T 292/102* (2015.04)

(58) Field of Classification Search

CPC ..... E05C 1/04; E05C 9/02
USPC ..... 292/137, 157, 160, 161, 162, 163, 164, 292/134

See application file for complete search history.

(56) References Cited

U.S. PATENT DOCUMENTS

| | | | | |
|---|---|---|---|---|
| 3,621,685 | A * | 11/1971 | Sargent | 70/107 |
| 4,437,695 | A * | 3/1984 | Foshee | 292/352 |
| 4,502,720 | A | 3/1985 | Fayerman et al. | |
| 4,569,547 | A | 2/1986 | Fayerman et al. | |
| 4,641,866 | A | 2/1987 | Haeck et al. | |
| 4,728,133 | A | 3/1988 | Valley | |
| 4,920,773 | A * | 5/1990 | Surko, Jr. | 70/224 |
| 5,481,890 | A | 1/1996 | Millman | |
| 5,564,296 | A | 10/1996 | Theriault et al. | |
| 5,732,578 | A | 3/1998 | Kang | |

(Continued)

FOREIGN PATENT DOCUMENTS

| | | |
|---|---|---|
| EP | 2273041 | 1/2011 |
| GB | 1039013 | 8/1966 |
| KR | 200426545 | 9/2006 |

OTHER PUBLICATIONS

Ironmongery Direct Ltd, "3 Lever Architectural Deadlock 75mm Case 57mm Backset—Bright Brass," (2005) http://www.ironmongerydirect.co.uk/Products/Locks_Latches_and_Security, 4 pages.

(Continued)

*Primary Examiner* — Kristina Fulton
*Assistant Examiner* — Nathan Cumar
(74) *Attorney, Agent, or Firm* — Michael Best & Friedrich LLP

(57) ABSTRACT

A door latch actuator includes a cage fixedly attached to a first surface and a torque plate coupled to the cage for rotation about a spindle axis. The torque plate includes a first engagement portion. An input member is rotatable about the spindle axis between a rest position and an actuated position. The input member has an actuator axis that is normal to the spindle axis. A spindle is coupled to the input member and includes a second engagement portion that is selectively engageable with the first engagement portion. The spindle is movable between an engaged position in which the torque plate holds the spindle and the input member in the rest position, and a disengaged position in which the spindle and the input member are movable with respect to the torque plate to change the orientation of the actuator axis when the input member is in the rest position.

19 Claims, 5 Drawing Sheets

(56) References Cited

U.S. PATENT DOCUMENTS

| | | | | |
|---|---|---|---|---|
| 6,048,007 | A * | 4/2000 | Shor | 292/348 |
| 6,619,710 | B1 | 9/2003 | Hwang | |
| 6,860,129 | B2 | 3/2005 | Eller et al. | |
| 2004/0123427 | A1 | 7/2004 | Lee | |
| 2004/0174020 | A1 | 9/2004 | Fishencord | |
| 2006/0196239 | A1 * | 9/2006 | Shen et al. | 70/224 |
| 2008/0087058 | A1 | 4/2008 | Chang | |
| 2008/0168809 | A1 | 7/2008 | Liu et al. | |
| 2008/0252086 | A1 | 10/2008 | Houis | |

OTHER PUBLICATIONS

PCT/US2013/047754 International Search Report and Written Opinion dated Aug. 23, 2013 (8 pages).

* cited by examiner

LEVER DROOP ADJUSTER FOR A DOOR LATCH ACTUATOR

BACKGROUND

The present invention relates to door hardware. More specifically, the present invention relates to door latch mechanisms.

SUMMARY

In one construction, the invention provides a door latch actuator for use with a door having a first surface and a second surface. The door latch actuator includes a cage fixedly attached to the first surface and a torque plate coupled to the cage for rotation about a spindle axis. The torque plate includes a first engagement portion. An input member is rotatable about the spindle axis between a rest position and an actuated position. The input member has an actuation axis that is normal to the spindle axis. A biasing member is coupled to the cage and the torque plate. The biasing member is operable to bias the torque plate toward a predetermined rotational position with respect to the cage. A spindle is coupled to the input member and includes a second engagement portion that is selectively engagable with the first engagement portion. The spindle is movable between an engaged position in which the torque plate holds the spindle and the input member in the rest position, and a disengaged position in which the spindle and the input member are movable with respect to the torque plate to change the orientation of the actuator axis when the input member is in the rest position.

In another construction, the invention provides a door latch actuator for use with a door having a first surface and a second surface. The door latch actuator includes a cage fixedly attached to the first surface and a torque plate coupled to the cage for rotation about a spindle axis. The torque plate includes a first toothed portion. A spindle includes a second toothed portion that is selectively engageable with the first toothed portion. The spindle is movable between an engaged position in which the rotational position of the spindle is fixed with respect to the torque plate and a disengaged position in which the spindle is rotatable about the spindle axis with respect to the torque plate such that the spindle is movable with respect to the torque plate to one of a plurality of selectable orientations. A lever is movable between a rest position and an actuated position. The lever has a lever portion that extends along a lever axis that is normal to the spindle axis. A biasing member is coupled to the cage and the torque plate. The biasing member is operable to bias the lever toward the rest position. The spindle is selectively rotated to one of the plurality of selectable orientations to position the lever axis in a horizontal position when the lever is in the rest position.

In yet another construction, the invention provides a method of adjusting the orientation of a lever for a door latch actuator, the door latch actuator including a cage fixedly attached to the door, a torque plate rotatably coupled to the cage, a biasing member coupled to the torque plate and the cage to rotationally bias the torque plate toward a predetermined position, and a spindle coupled to the lever for rotation and selectively engagable with the torque plate. The method includes disconnecting the lever from the spindle, removing the lever from the spindle, pressing the spindle toward the door such that the spindle moves along a spindle axis, and disengaging a first engagement portion of the spindle from a second engagement portion of the torque plate in response to movement of the spindle along the spindle axis toward the door. The method also includes rotating the spindle in a desired direction of adjustment, releasing the spindle to move the spindle along the spindle axis away from the door, engaging the first engagement portion of the spindle with the second engagement portion of the torque plate in response to movement of the spindle along the spindle axis away from door, and connecting the lever to the spindle in a new orientation with respect to the fixed cage.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
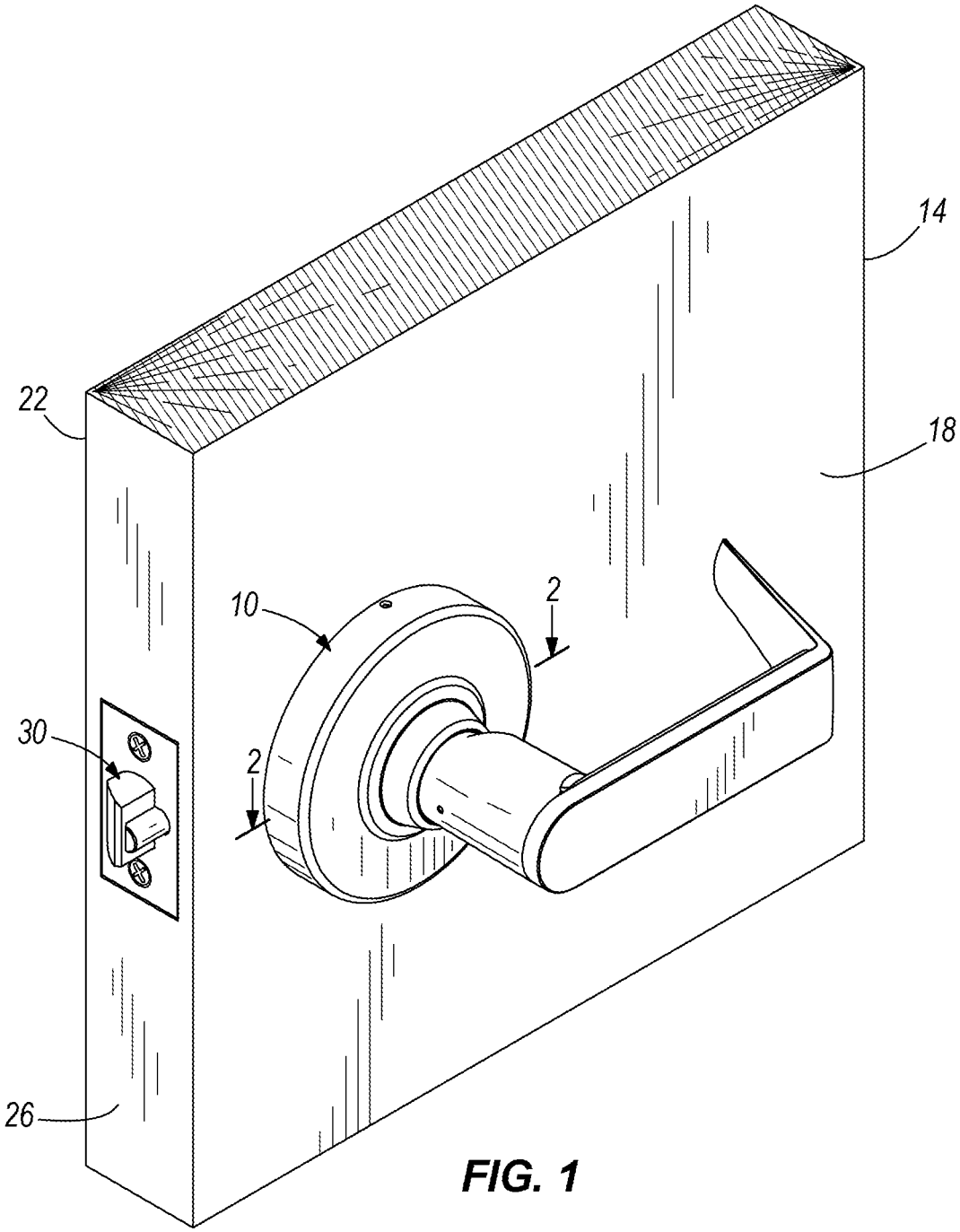
FIG. 1 is a perspective view of a portion of a door including a door latch actuator having a lever actuator.

Referring to FIG. 1, the present invention provides a door latch actuator 10 for use with a door 14. The door 14 has a first (or inside) surface 18 and second (or outside) surface 22 substantially opposite the first surface 18. A lateral latch edge 26 extends between the first surface 18 and the second surface 22.

The door latch actuator 10 interfaces with a latch assembly 30 that is flush with the latch edge 26 of the door 14 for selectively coupling the door 14 to a door frame (not shown), as will be well understood in the art. The latching assembly 30 is movably coupled to the door latch actuator 10.

Figure 3:
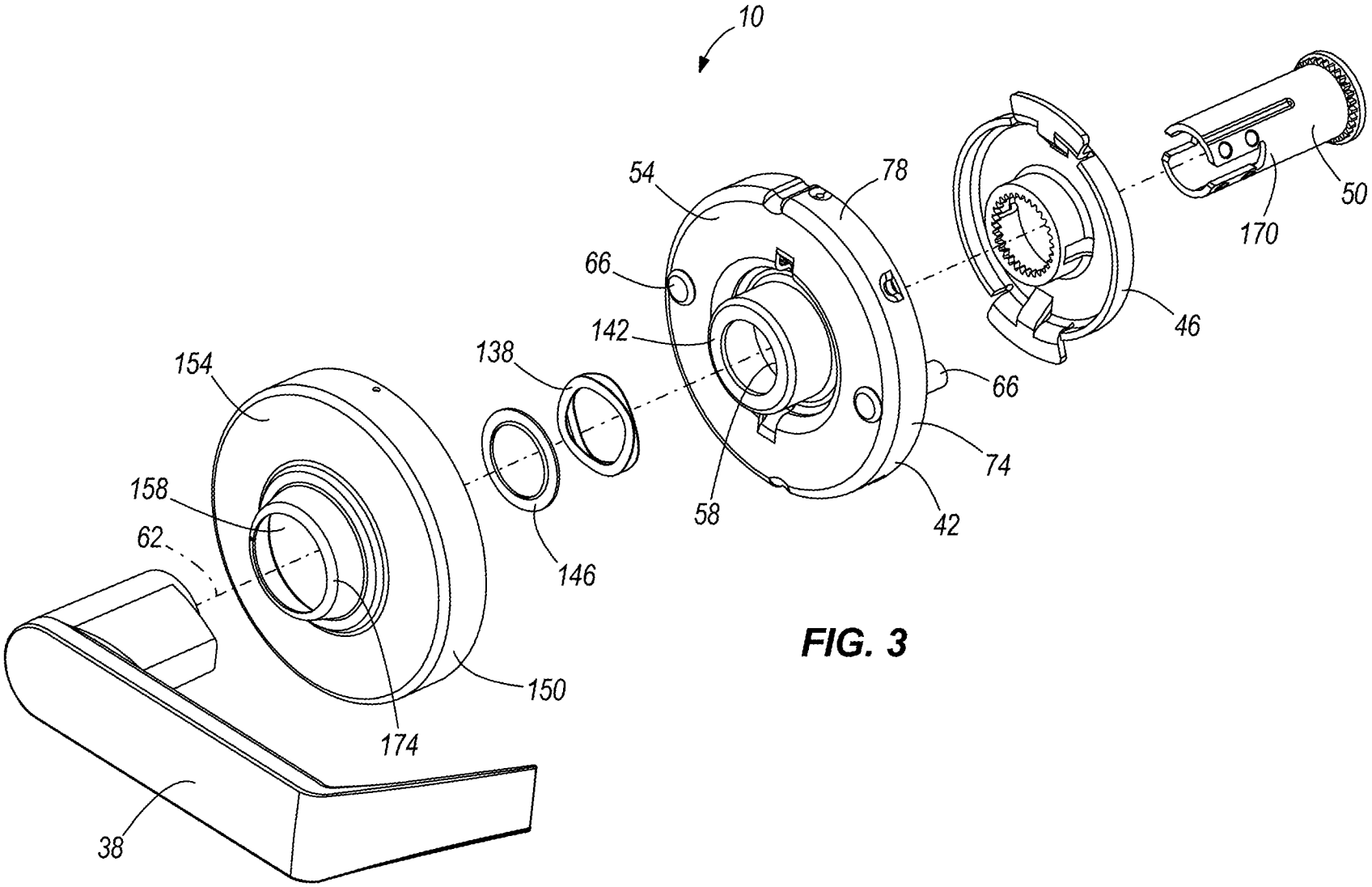
FIG. 3 is an exploded perspective view of a portion of the door latch actuator including the lever.

Referring to FIG. 3, the door latch actuator 10 includes an input member 38, a cage 42, a torque plate 46, and a spindle 50. The cage 42 is fixedly attached to the first surface 18 of the door 14. The cage 42 includes an annular wall 54 surrounding a central aperture 58. The central aperture 58 is centered about, and substantially perpendicular to, a spindle axis 62. The annular wall 54 includes a lip 74 coupled to an outer edge 78 of the wall 54. A pair of mounting extensions 66 extend through the wall 54. Each mounting extension 66 includes an aperture 70 (FIG. 6) for receiving a fastener of an opposing portion of the door latch actuator 10 (not shown).

Figure 4:
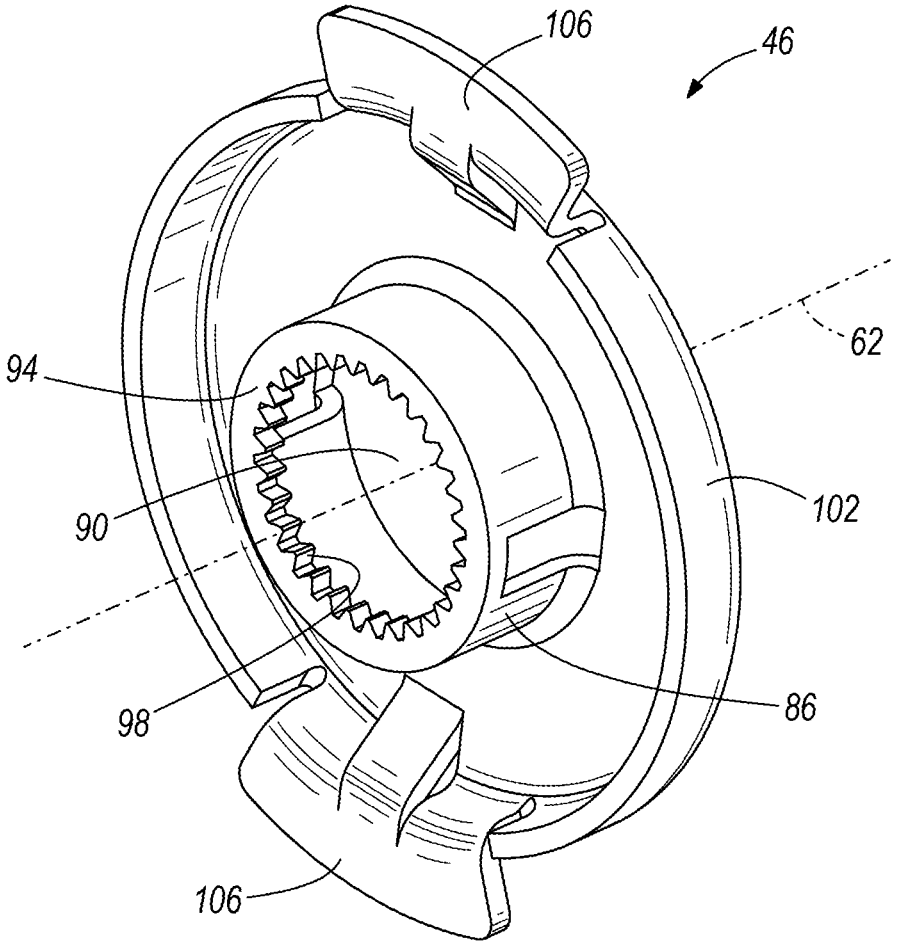
FIG. 4 is a perspective view of a torque plate of the door latch actuator of FIG. 1.

The torque plate 46 is selectively coupled to the cage 42 for rotation about the spindle axis 62 with respect to the cage 42. Referring to FIG. 4, the torque plate 46 includes a substantially cylindrical inner body 86 defining a central aperture 90 and a first engagement portion 94. The first engagement portion 94 includes a plurality of inwardly facing, substantially radial teeth 98 disposed about the spindle axis 62. A cup-like annular wall 102 surrounds the cylindrical inner body 86. Opposing wing members 106 extend outwardly radially from the annular wall 102.

Figure 2:
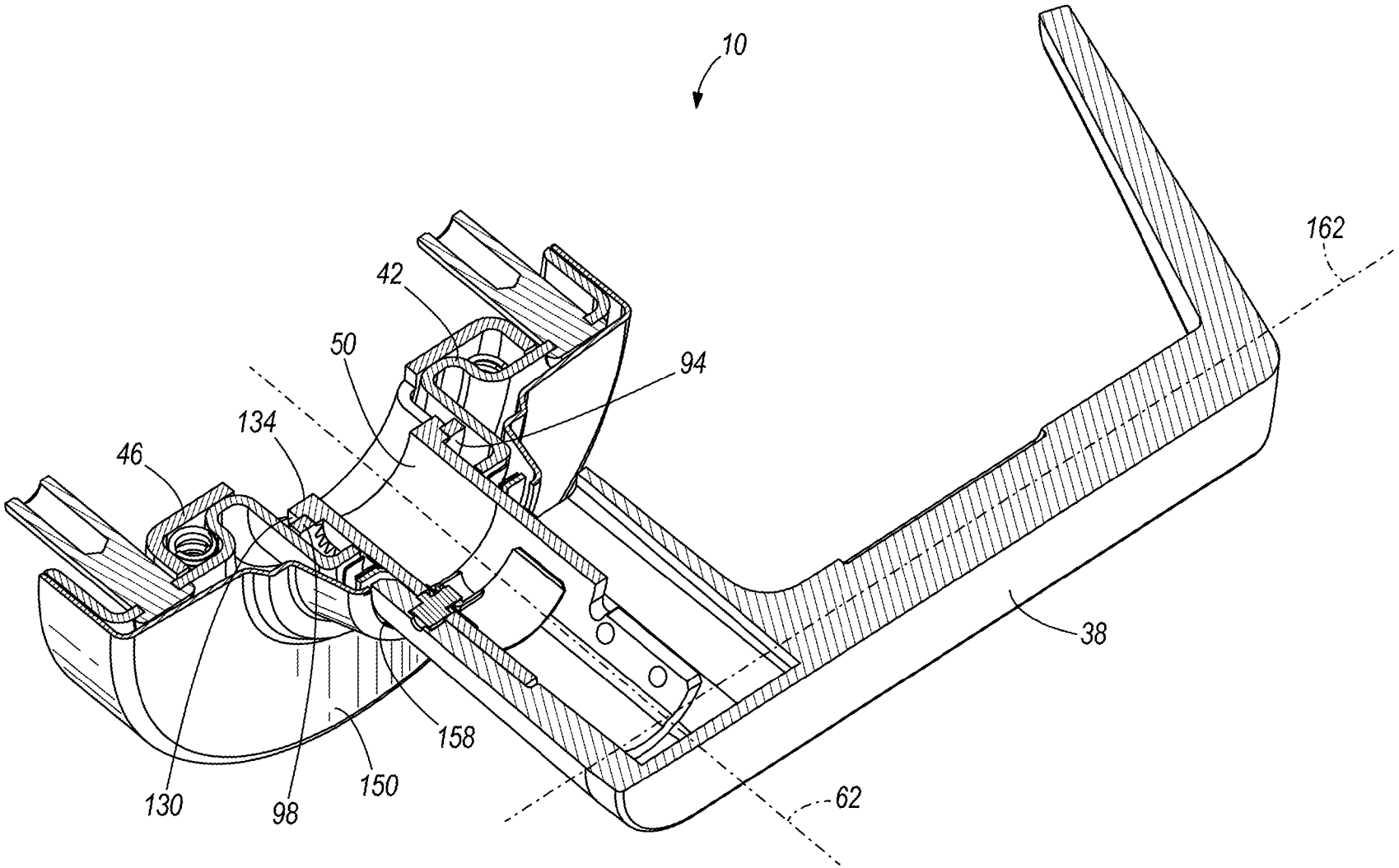
FIG. 2 is a section view of a portion of the door latch actuator including the lever actuator in an engaged position taken along line 2-2 of FIG. 1.
Figure 5:
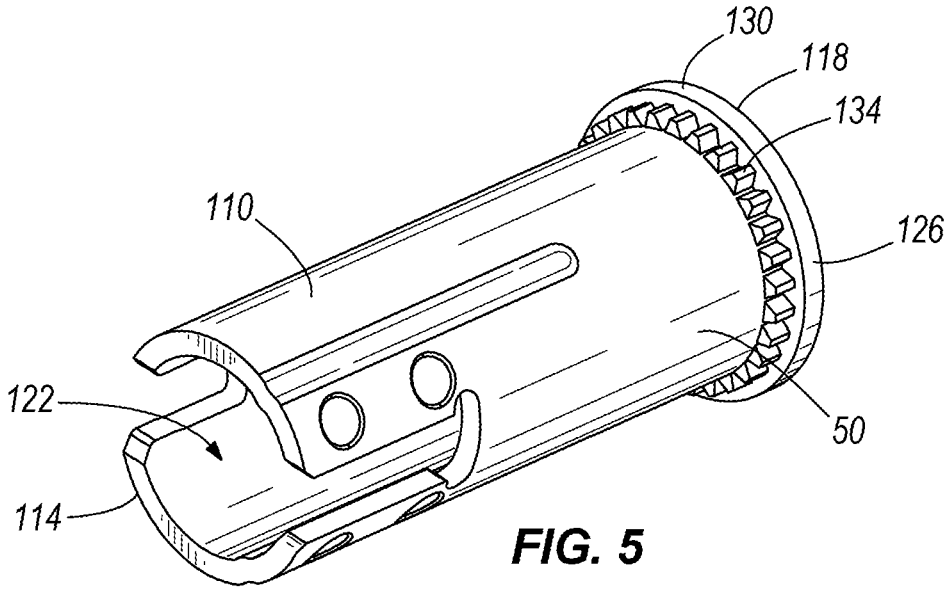
FIG. 5 is a perspective view of a spindle of the door latch actuator of FIG. 1.

Referring to FIG. 5, the spindle 50 includes a substantially cylindrical body 110 with a first end 114 and a second end 118. The first end 114 defines an aperture 122 for receiving, for example, a lock cylinder assembly. The second end 118 includes a flange 126. The flange 126 defines a second engagement portion 130 including a plurality of outwardly extending teeth 134. The second engagement portion 130 is selectively engageable with the first engagement portion 94. As shown in FIGS. 2 and 3, the spindle 50 is coupled via the first engagement portion 94 and the second engagement portion 130 to the torque plate 46 for rotation about the spindle axis 62.

As shown in FIG. 3, a biasing member or compression spring 138, more specifically a wave-spring 138, is coupled adjacent to an exterior portion 142 of the cage 42 about the spindle axis 62. A retaining ring 146 is located adjacent to the compression spring 138 about the spindle axis 62 to maintain the position of the cage 42 within an exterior cover plate or a rose 150.

The rose 150 includes an annular wall 154 defining a central aperture 158. The central aperture 158 is centered about the spindle axis 62. The rose 150 receives the retaining ring 146, the compression spring 138, and the cage 42 that houses the torque plate 46 and the spindle 50. The central aperture 158 receives the spindle 50.

Figure 6:
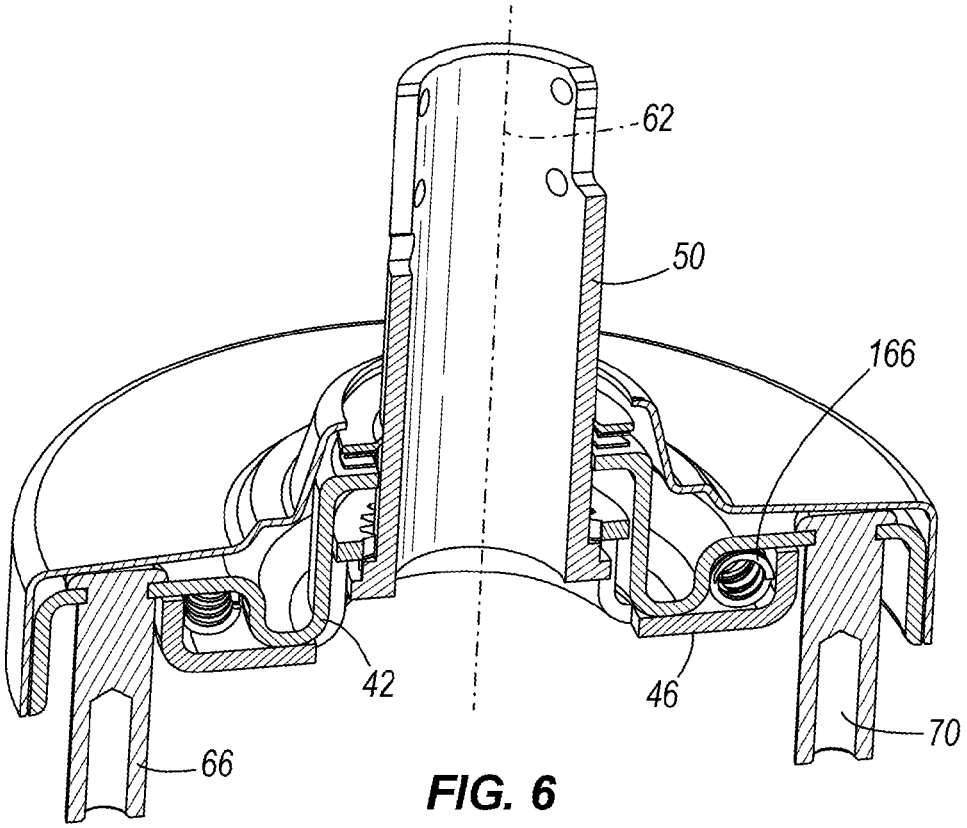
FIG. 6 is a section view of a portion of the door latch actuator in a disengaged position taken along line 2-2 of FIG. 1.

The input member 38, may be, for example, a lever. As shown in FIG. 6, the input member 38 is coupled to the spindle 50 and is rotatable about the spindle axis 62 between a rest position and an actuated position. The input member 38 includes an actuator axis 162 (shown in FIG. 2) that is normal to the spindle axis 62.

The spindle 50 is movable between an engaged position in which the torque plate 46 holds the spindle 50 and the input member 38 in the rest position as shown in FIG. 2, and a disengaged position, shown in FIG. 6 in which the spindle 50 is movable with respect to the torque plate 46 to change the orientation of the actuator axis 162 when the input member 38 is in the rest position.

Referring to FIG. 6, a biasing member 166 is coupled to the cage 42 and the torque plate 46. The biasing member 166, may be, for example, one or more coil springs. The biasing member 166 is operable to bias the input member 38 (FIG. 2) toward a user selected fixed position with respect to the torque plate 46. Typically, the user selected position results in the actuator axis 162 being substantially horizontal in the rest position.

FIG. 2 illustrates the door latch actuator 10 in an operational state. The plurality of teeth 98 on the first engagement portion 94 are engaged with the plurality of teeth 134 on the second engagement portion 130, such that the spindle 50 is engaged to the torque plate 46 for rotation with the torque plate about spindle axis 62. In the operational state, the torque plate 46 biases the spindle 50 and the input member 38 in a rest orientation.

From the operational state shown in FIG. 2, the input member 38 may be disengaged and removed from the spindle 50 and the central aperture 158 of the rose 150. The spindle 50 is pressed towards the door 14 (shown in FIG. 1) along the spindle axis 62, as shown in FIG. 6.

Figure 7:
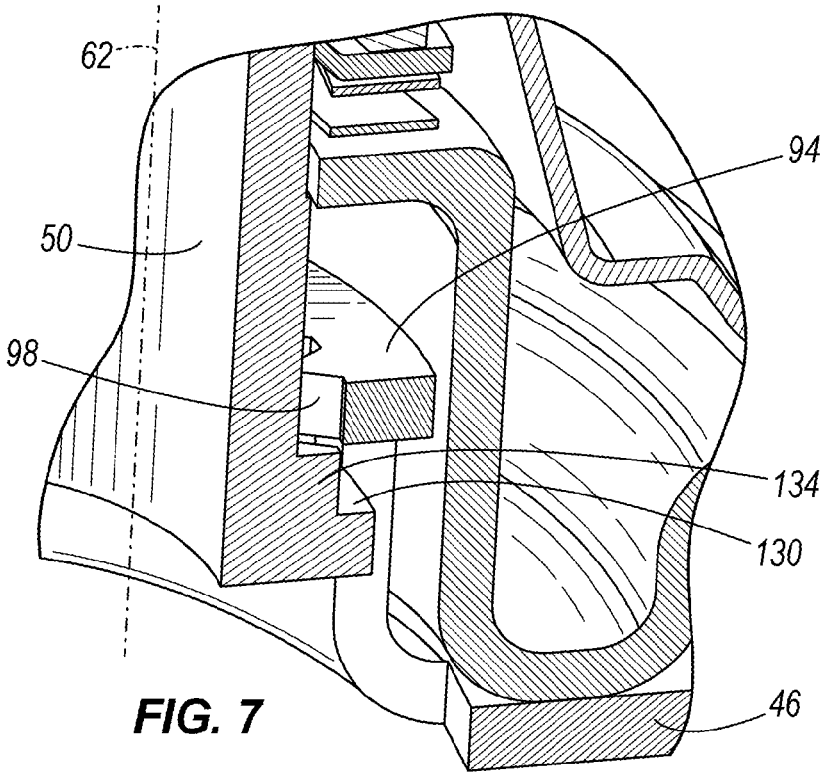
FIG. 7 is an enlarged perspective view of a portion of the torque plate and spindle of FIGS. 4 and 5 in the disengaged position.

As shown in FIG. 7, movement of the spindle 50 along the spindle axis 62 against the biasing member 138 disengages the plurality of teeth 98 on the first engagement portion 94 from the plurality of teeth 134 on the second engagement portion 130. In this position, the input member 38 (not shown) and the spindle 50 are movable with respect to the torque plate 46. Once disengaged, the spindle 50 may be rotated in a preferably counterclockwise direction to change the orientation of the actuator axis 162. Manual rotation of the spindle 50 overcomes the bias of the biasing member 166. The spindle 50 shall be rotated until a movable indicator or slot 170 on the spindle 50 aligns with a fixed indicator or slot 174 provided on the rose 150 as shown in FIG. 3.

Upon obtaining the desired direction of adjustment, the spindle 50 may be moved by the biasing member 138 along the spindle axis 62 away from the door 14 (shown in FIG. 1) such that the plurality of teeth 98 on the first engagement portion 94 return into engagement with the plurality of teeth 132 on the second engagement portion 130 as shown in FIG. 2. The input member 38 is connected to the spindle 50 in a new orientation with respect to the fixed cage 42.

Various features and advantages of the invention are set forth in the following claims.

What is claimed is:

1. A door latch actuator for use with a door having a first surface and a second surface, the door latch actuator comprising:

a cage fixedly attached to the first surface;

a torque plate coupled to the cage for rotation about a spindle axis, the torque plate including a first engagement portion;

an input member rotatable about the spindle axis between a rest position and an actuated position, the input member having an actuator axis that is normal to the spindle axis;

a first biasing member coupled to the cage and the torque plate, the first biasing member operable to bias the torque plate toward a predetermined rotational position with respect to the cage;

a spindle coupled to the input member and including a second engagement portion that is selectively engageable with the first engagement portion; and a second biasing member adjacent the cage and positioned about the spindle, wherein the spindle is movable between an engaged position in which the torque plate holds the spindle and the input member in the rest position, and a disengaged position in which the spindle and the input member are movable with respect to the torque plate to change the orientation of the actuator axis when the actuator is in the rest position, and wherein the second biasing member biases the spindle toward the engaged position.

2. The door latch actuator of claim 1, wherein the first engagement portion includes a first plurality of teeth that extend radially inward toward the spindle axis.

3. The door latch actuator of claim 2, wherein the second actuator portion includes a second plurality of teeth that extend radially outward away from the spindle axis.

4. The door latch actuator of claim 3, wherein the first plurality of teeth engage the second plurality of teeth in the engaged position, and wherein movement of the spindle toward the disengaged position disengages the first plurality of teeth and the second plurality of teeth.

5. The door latch actuator of claim 1, further comprising a flange formed as part of the spindle and selectively engageable with the torque plate to allow movement of the spindle in a first direction from the engaged position toward the disengaged position and to inhibit movement of the spindle from the engaged position in a second direction opposite the first direction.

6. The door latch actuator of claim 1, wherein the input member includes a lever that extends along the actuator axis.

7. The door latch actuator of claim 1, wherein the biasing member includes a coil spring.

8. The door latch actuator of claim 1, wherein the input member is removably coupled to the spindle and wherein, when attached, the spindle and the input member are fixed for rotation.

9. The door latch actuator of claim 1, further comprising a movable indicator formed as part of the spindle and a fixed indicator fixed with respect to the spindle, the fixed indicator and the movable indicator positioned such that when they are aligned, the actuator axis is horizontal when the actuator is in the rest position.

10. A door latch actuator for use with a door having a first surface and a second surface, the door latch actuator comprising:

a cage fixedly attached to the first surface;

a torque plate coupled to the cage for rotation about a spindle axis, the torque plate including a first toothed portion;

a spindle including a second toothed portion that is selectively engageable with the first toothed portion, the spindle movable between an engaged position in which the rotational position of the spindle is fixed with respect to the torque plate and a disengaged position in which the spindle is rotatable about the spindle axis with respect to the torque plate;

a lever movable between a rest position and an actuated position, the lever having a lever portion that extends along a lever axis that is normal to the spindle axis;

a first biasing member coupled to the cage and the torque plate, the first biasing member operable to bias the lever toward the rest position, wherein in the disengaged position, the spindle is selectively rotated to one of a plurality of selectable orientations to position the lever axis in a horizontal position when the lever is in the rest position; and a second biasing member adjacent the cage and positioned about the spindle, wherein the second biasing member biases the spindle toward the engaged position.

11. The door latch actuator of claim 10, further comprising a movable indicator formed as part of the spindle and a fixed indicator fixed with respect to the spindle, the fixed indicator and the movable indicator positioned such that when they are aligned, the lever axis is horizontal when the lever is in the rest position.

12. The door latch actuator of claim 1, wherein the first plurality of teeth extend radially inward toward the spindle axis and the second plurality of teeth extend radially outward away from the spindle axis.

13. The door latch actuator of claim 10, wherein the first toothed portion includes a first quantity of teeth and the second toothed portion includes a second quantity of teeth and the number of selectable orientations is about equal to the greater of the first quantity of teeth and the second quantity of teeth.

14. The door latch actuator of claim 10, further comprising a flange formed as part of the spindle and selectively engageable with the torque plate to allow movement of the spindle in a first direction from the engaged position toward the disengaged position and to inhibit movement of the spindle from the engaged position in a second direction opposite the first direction.

15. The door latch actuator of claim 10, wherein the lever is removably coupled to the spindle and wherein, when attached, the spindle and the lever are fixed for rotation.

16. A method of adjusting the orientation of a lever for a door latch actuator, the door latch actuator including a cage fixedly attached to a door, a torque plate rotatably coupled to the cage, a first biasing member coupled to the torque plate and the cage to rotationally bias the torque plate toward a predetermined position, a spindle coupled to the lever for rotation and selectively engagable with the torque plate, and a second biasing member adjacent the cage and positioned about the spindle, the method comprising:

disconnecting the lever from the spindle;

removing the lever from the spindle;

biasing the spindle along a spindle axis in a direction away from the door with the second biasing member;

pressing the spindle toward the door such that the spindle moves along the spindle axis;

disengaging a first engagement portion of the spindle from a second engagement portion of the torque plate in response to movement of the spindle along the spindle axis toward the door;

rotating the spindle in a desired direction of adjustment;

releasing the spindle to move the spindle along the spindle axis away from the door;

engaging the first engagement portion of the spindle with the second engagement portion of the torque plate in response to movement of the spindle along the spindle axis away from door; and connecting the lever to the spindle in a new orientation with respect to the fixed cage.

17. The method of claim 16, wherein disengaging the first engagement portion of the spindle from the second engagement portion of the torque plate includes unmeshing a first plurality of teeth in the first engagement portion from a second plurality of teeth in the second engagement portion.

18. The method of claim 1, wherein engaging the first engagement portion of the spindle with the second engagement portion of the torque plate includes meshing the first plurality of teeth in the first engagement portion with the second plurality of teeth in the second engagement portion.

19. The method of claim 16, further comprising rotating the spindle about the spindle axis with respect to the torque plate to move the spindle to the new orientation.

* * * * *